US008419004B2

(12) United States Patent
Stauber

(10) Patent No.: US 8,419,004 B2
(45) Date of Patent: Apr. 16, 2013

(54) DEVICE AND METHOD FOR COLLATING TWO-DIMENSIONAL OBJECTS

(75) Inventor: Hans Ulrich Stauber, Grut (CH)

(73) Assignee: Ferag AG, Hinwil (CH)

( * ) Notice: Subject to any disclaimer, the term of this patent is extended or adjusted under 35 U.S.C. 154(b) by 24 days.

(21) Appl. No.: 13/127,343

(22) PCT Filed: Nov. 2, 2009

(86) PCT No.: PCT/CH2009/000346

§ 371 (c)(1),
(2), (4) Date: Jun. 28, 2011

(87) PCT Pub. No.: WO2010/051651

PCT Pub. Date: May 14, 2010

(65) Prior Publication Data

US 2011/0248438 A1 Oct. 13, 2011

(30) Foreign Application Priority Data

Nov. 4, 2008 (CH) ..... 1724/08

(51) Int. Cl.
*B65H 39/00* (2006.01)

(52) U.S. Cl.
USPC ..... 270/52.14; 270/52.16; 270/52.19

(58) Field of Classification Search ..... 270/52.14, 270/52.16, 52.19, 52.04, 58.23, 58.29; 271/204, 271/206, 82, 85
See application file for complete search history.

(56) References Cited

U.S. PATENT DOCUMENTS

| | | | | |
|---|---|---|---|---|
| 3,926,423 | A * | 12/1975 | Merker et al. | 270/52.16 |
| 5,269,504 | A | 12/1993 | Backman | |
| 5,765,823 | A * | 6/1998 | Meier et al. | 270/58.23 |
| 6,270,076 | B1 * | 8/2001 | Reist | 271/302 |
| 6,311,968 | B1 | 11/2001 | Linder et al. | |
| 7,284,750 | B2 * | 10/2007 | Glowner | 270/52.14 |
| 7,661,665 | B2 * | 2/2010 | Egli | 270/52.17 |
| 8,056,892 | B2 * | 11/2011 | Honegger | 270/58.23 |
| 2005/0116404 | A1 | 6/2005 | Glowner | |

FOREIGN PATENT DOCUMENTS

WO 2004/074153 9/2004

* cited by examiner

*Primary Examiner* — Leslie A Nicholson, III
(74) *Attorney, Agent, or Firm* — Rankin, Hill & Clark LLP

(57) ABSTRACT

An apparatus and a method for compiling flat objects, wherein a gripper conveyor is used, the grippers of which either act directly as support elements or contact surfaces for the products to be compiled, thereby constituting a receiving unit, or interact with a separate support element to form a receiving unit. The use of a gripper conveyor having a controllable opening state and a controllable orientation of the gripper jaws of the individual grippers, and/or a controllable orientation of the separate support elements, has the advantage that the orientation of the contact surfaces and the clamping function within a receiving unit can be set independently of the adjoining receiving units. In this way, greater flexibility is attained.

17 Claims, 7 Drawing Sheets

1
2
3
4
10,12
14,20
16
18
22
30
40
42
42
46
50
52
100
100
110
110
U
U1
U2
U3
U4
S1
S2
S3
S4
Z
F
F 10
12
30
40
42
42
46
50
U
U1
U2
U3
U4
S1
S2
Z
F

DEVICE AND METHOD FOR COLLATING TWO-DIMENSIONAL OBJECTS

BACKGROUND OF THE INVENTION

1. Field of the Invention

The invention lies in the field of conveying technology and relates to a device and to a method for collating two-dimensional objects. The invention may in particular be applied for forming stacks of products lying on one another; such a stack formation for example is a step with the manufacture of printed products which consists of several part printed products and other products such as e.g. CDs, product samples and other things, e.g. newspapers, magazines, brochures, books and likewise.

2. Description of Related Art

The collation of printed products is understood by the man skilled in the art as the placing of different printed products onto one another, into stacks. Usually, the same printed products lie on one another in the same sequence in all stacks. The stacks may however, as the case may be, also differ from one another by way of the fact that individual printed products are absent in individual stacks. The printed products are for example individual, unfolded or folded sheets or signatures which are folded several times. The printed products which are collated into a stack differ from one another with respect to their printed content, but may however also differ with regard to their shape.

Known devices for collating printed products comprise a plurality of conveyer compartments which are moved along a conveying path. Usually, several feed units are arranged along a collation and stretch along the conveying path, and these are designed for feeding printed products of a single type. The exits of the feed units which are directed towards the conveyor compartments are essentially arranged one after the other in a row, whose direction corresponds to the conveying direction of the compartments along the collation stretch. In each case, one compartment is aligned onto, in each case, one feed exit during the feed steps. The feed units are for example feeders, reel stations or on-line connections to devices, in which the printed products to be collated are created or processed.

In collation devices, in which the printed products are fed to the compartments essentially perpendicularly to the conveying direction, usually the compartments are stationary during the feed steps and the printed products are pushed or thrown from the side into the compartments which are directed onto the feed exits. Between successive feed steps, the printed products with the compartments are displaced by the distance between consecutive feed exits (or by an integer fraction of this distance), in a manner such that the compartments aligned onto the exits are replaced by compartments following these. The compartments of such a device are usually arranged in a manner such that the printed products lay therein horizontally or in a slightly sloping manner. Disadvantages exist in the necessary intermittent stop- and go operation of the conveying means for the compartments.

Collation devices with compartments moving in an essentially continuous manner in the collation direction do not have these disadvantages. The printed products, however, must be essentially equally aligned with the collation direction and must be pushed or thrown into the compartments in a manner which is exactly synchronised with these compartments, wherein their speed is also to be adapted to the conveying speed of the compartments, for feeding the printed products to continuously moving compartments without any problem. The compartments, for example, are formed by a conveyor belt with separating walls which are arranged transversely and, as the case may be, also longitudinally to the belt length, wherein in each case two adjacent transverse walls delimit a compartment. The fed printed products are stacked in a lying manner on the conveyor belt in these compartments. Further known collation devices with continuously conveyed compartments have V-shaped or L-shaped compartments, in which the fed printed products stand on an edge and lean on a compartment wall, as a rest surface/support surface, which leads or trails in the collation direction.

A collation device with compartments which are L-shaped in the longitudinal section in the conveying direction and which are moved through the collation region by a conveying member along a closed revolving path, is known from WO 2007/085101. The longer compartment wall which is orientated essentially horizontally in the collation region, serves as a rest surface for the objects, and the shorter compartment wall which is essentially vertically orientated in the collation region, serves as an abutment, on which the leading edges of the objects are aligned. The compartments are arranged in a pivotable manner relative to the conveying member. Their pivot position is controlled such that the orientation of the rest surface in space remains constant independent of the shape of the conveying path, and specifically with a slight inclination in the conveying direction. In this manner, it is possible for the stacks to remain lying in the rest surfaces without them being actively held, even with a change of the conveying direction, e.g. in curved sections of the conveying path.

A further collation device is known from WO 2008/058405, with which the walls of all compartments are defined by continuous belts which run around deflection means. By way of the zigzag-like deflection along the conveying path, the belts open out a plurality of compartments which are L-shaped in section and which are directly consecutive to one another without interruption. The orientations of the side walls of adjacent compartments may be set in dependence on one another, by way of changing the position of the deflection means (rollers, rods). The long side wall, for example, is inclined relative to the conveying path or to the conveying member, and the short side wall is orientated in an essentially vertical manner, so that an oblique rest surface and an abutment which projects upwards from this are formed. In an alternative configuration, the two side walls are orientated parallel to the conveying path and may enclose a stack between them. By way of this, it is possible to convey the stack also with a rest surface which is arranged in a steep manner or above the stack (upside down). The orientation of the side walls of adjacent compartments, however, may not be selected independently of another, since the belts run over the mentioned common deflection means, so that the angle of inclination of the rest surface and the opening angle between the side walls are coupled to one another.

A further collating conveyor is known from DE-A 31 45 491. It comprises a plurality of grippers, wherein the rest surface which is assigned to a gripper, for supporting the laid-on products, is formed by the upwardly pointing gripper jaw of the gripper leading in the conveying direction. With this, the inclination angle of the rest surface and the opening angle of the grippers are likewise not independent of one another. The inclination is moreover opposite to the conveying direction.

BRIEF SUMMARY OF THE INVENTION

It is the object of the invention, to provide a collation device and a corresponding method, with which device or with which method the objects may be reliably received, aligned and conveyed, wherein it is desirable to be able to hold the collated objects as a stack independently of the orientation of the compartments.

The device according to the invention serves for collating two-dimensional objects, in particular printed products and other products, and for the further conveying of the collated objects as stacks. It comprises a plurality of receiver units which are movable in a conveying direction along a closed conveying path defined by a conveying member. Moreover, a plurality of support elements are present, which at least in a collation region of the conveying path define a rest surface inclined in the conveying direction, on which the objects may be deposited and align themselves due to the inclination. The receiver units, according to the invention, comprise grippers with a first and second gripper jaw, which in a manner known per se, may assume a clamping position and an open position. The grippers, at least in the collation region, are arranged and moved relative to the support elements, such that they may firmly hold stacks formed on the support elements and convey them further in the held condition, by way of closure of the grippers. The grippers optionally, at least in the collation region, form an abutment for the objects lying on the rest surface, on which abutment the objects are aligned, in particular on account of gravity. The grippers and the support elements may be controlled such that within a receiver unit, the orientation of the rest surface relative to the conveying path and/or an opening angle between the first and the second gripper jaw may be set independently of adjacent receiver units. Preferably, the grippers for this are connected to the conveying member and controllable, wherein this connection and control are of a manner such that the orientation of the grippers relative to the conveying path, and/or an opening angle between the first and second gripper jaw, may be set independently of adjacent grippers.

The operating method according to the invention comprises the following steps: moving the receiver units in the conveying direction along the closed conveying path; feeding individual objects one after the other to the receiver units in the collation region of the conveying path; laying the objects onto the rest surfaces of the receiver units for forming stacks; closing the grippers after forming the stack and further conveying the stack by the grippers.

The invention is based on the idea of using a gripper conveyor known per se and having grippers, whose orientation and opening condition may be controlled independently of one another, for collating flat objects or for the stack formation and for the subsequent conveying of the stacks. This idea differs fundamentally from the initially described known concepts in the field of collation. With these concepts, the compartments are always applied with large-surfaced rest surfaces and rigid compartment walls or compartment walls which are variable in their orientation as the case may be. In contrast, the invention has the following advantages:

In principle, one may apply known gripper conveyors which are modified by way of suitable support elements, so that the objects in the collation region, in which the grippers are still open, are securely supported, in particular from below. The stacks of objects, after the collation and by way of closing the grippers, may be reliably held and conveyed further also over longer stretches without displacements within the stack. Therefore, in contrast to the state of the art, it is not necessary to transfer the stacks into grippers for the further conveying. The stacks may be gripped directly at the location of their completion. Since the grippers may be individually activated, defect stacks may be ejected out in a simple manner, e.g. by way of the gripper being opened with upside down conveying. The stack transfer to an optionally present conveying-away device is effected in an extremely controlled manner, since the orientation of the grippers and the point in time of the opening may be set in a very accurate manner. As with the devices according to WO 2007/085101 or WO 2008/058405, one may realise constant orientations of the rest surface in the collation region, even with a bent conveying path, but in the present case in a significantly simpler manner and with an increased flexibility.

The support elements, as with the state of the art, may be an integral constituent of the receiver units and therefore are co-moved along the entire conveying path. Since, according to the invention, grippers are applied as receiver units, the support elements may be an integral constituent of the grippers or be connected to the gripper in a fixed or articulated manner e.g. in the form of a rigid or flexible continuation. In an advantageous further formation of the invention, the support elements are formed by one of the gripper jaws which are extended compared to the other gripper jaw. The extended gripper jaw is then arranged in the collation region, preferably in an essentially lying manner, thus horizontally or with only a small inclination, and the other gripper jaw preferably projects upwards. The gripper, simultaneously with the rest surface, thus forms an abutment for the leading product edges.

The support elements may, however, also be formed by way of separate elements which for example are only moved synchronously with the grippers in the collation region and then removed again as soon as the grippers, by way of transition into the clamping position, securely firmly hold the finished stacks and convey them further. This has the advantage that a conventional gripper conveyor may be applied, which is only supplemented in the collation region by a support element conveyor.

The grippers are controlled such that they are open in the collation region and are closed after completion of the stack formation. The support elements are arranged such that they receive the products in an essentially lying manner in the collation region. The gripper is arranged relative to the support element such that it may hold the products lying on the rest surface between its two gripper jaws, by way of closure. It optionally also acts as an abutment for the alignment of the products.

The gripper jaw may be designed in a relative narrow manner transversely to the conveying direction, i.e. e.g. narrower than the product width in the respective direction. This renders it possible to laterally align the products already during the feeding, so that they are exactly aligned with respect to the support surface of the gripper. Suitable aligning elements may be arranged at a distance to one another on both sides of the movement path of the grippers, wherein the grippers run through between the aligning elements. Such an arrangement of the aligning elements is not possible with the state of the art for reasons of space, since the compartments are wider.

The realisation of the receiver units by way of grippers has the further advantage that the conveying path is not limited to stretches which are straight in a plan view, but that they may have a ground view with direction changes. This is because, different to the devices known from the state of the art on the basis of deflected belts (e.g. according to WO 2008/058405) or rigid compartments, grippers may be led along infinite spatial curves, also those with a small radius of curvature. A plan view with differently orientated and/or arcuate sections, e.g. U-shaped or L-shaped ones, has the advantage that the complete installation may be adapted to existing factory buildings. One may accommodate more feed stations (feeders) in an existing room, than with installations which are limited to a straight plan view or straight collation region. Also two or more collation regions may be present, in which the conveying direction is different, e.g. runs anti-parallel or at 90° to one another.

BRIEF DESCRIPTION OF THE DRAWINGS

Examples of the invention are represented in the drawings and are described hereinafter. In a purely schematic manner are shown in.

DETAILED DESCRIPTION OF THE INVENTION

Figure 1:
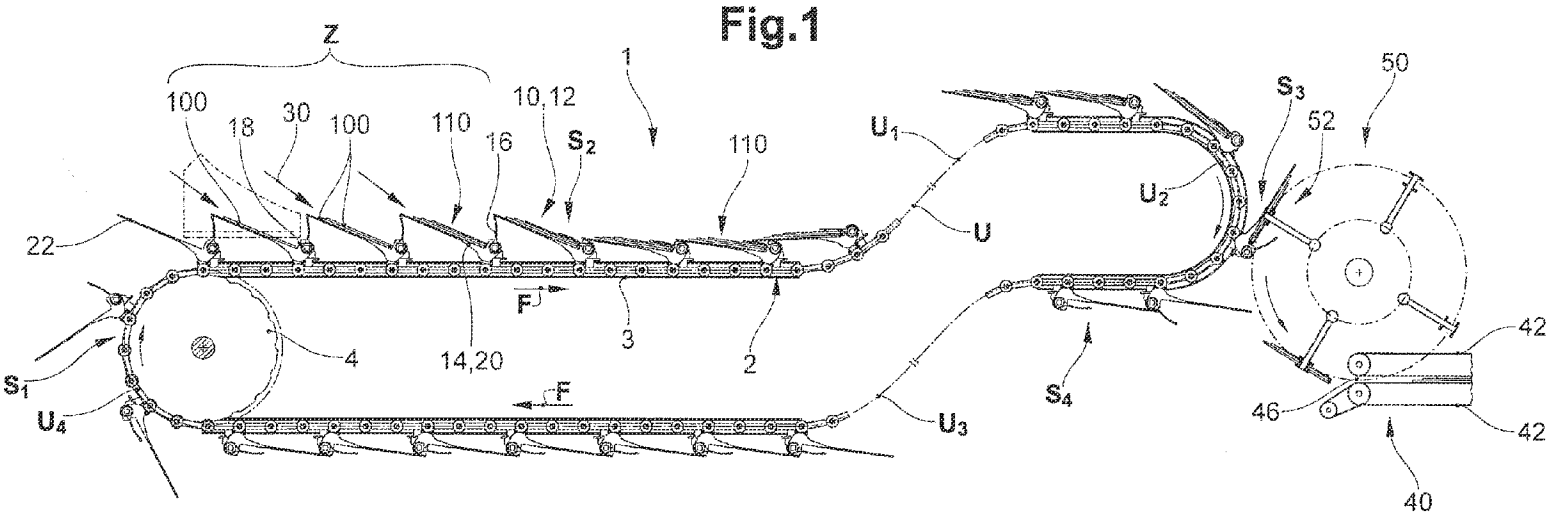
FIG. 1 a collation device with support elements which are an integral consistent of the grippers.

FIG. 1 shows a collation device 1 according to the invention, with a plurality of receiver units 10 which are moved along a closed conveying path U. The receiver units 10 are moved by way of a conveyor member 2, here a chain, along the conveying path U which is defined by straight and curved channel pieces 3 and deflections 4. The conveying path U here by way of example has two parallel path pieces U1, U3 which are connected to one another by way of circular transition pieces U2, U4. Products 100 or products stacks 110 are transported along the upper path piece U1 and the deflection region U2 which is on the right in the drawing, whilst the lower path piece U3 and the left deflection region U4 serves for leading back the empty receiver units 10 or grippers 12. Feed devices 30 for individual objects 100 are arranged above a part of the upper path piece U1. A collation region Z of the conveying path U is defined by way of this. The exits of the feed devices 30 lie in this collation region one after the other in a row essentially parallel to the conveying path U. A conveying-away device 40 for stacks 110 as well as a transfer device 50, with which the stacks 110 are taken from the receiver units 10 and are transferred to the conveying-away device 40, are located in the right deflection region U2.

The collation device 1, according to the invention, is based on a gripper conveyor with a plurality of grippers 12, which here represent the receiver units 10. The grippers 12 have two gripper jaws 14, 16 whose position relative to one another (open/clamping position) as well as their orientation in space or relative to the conveying path U may be set individually or independently of the adjacent gripper by way of suitable control means. Here, the grippers are opened at an opening location S1 in front of the collation region Z, are moved in the opened condition through the collation region Z and at the end of the collation region Z are closed again at a closure location S2. In the collation region Z, the individual products are fed one after the other, so that stacks 110 are formed and are transported by the grippers 12. At a further opening location S3, the grippers 12 are opened for the purpose of transfer of the stacks 110 to the transfer device and subsequently are closed at a further closure location S4, in order in the closed, empty condition, to be moved along the lower path piece U3. Moreover, the gripper orientation is changed in the region around the opening/closure locations S1, S2.

Figure 2:
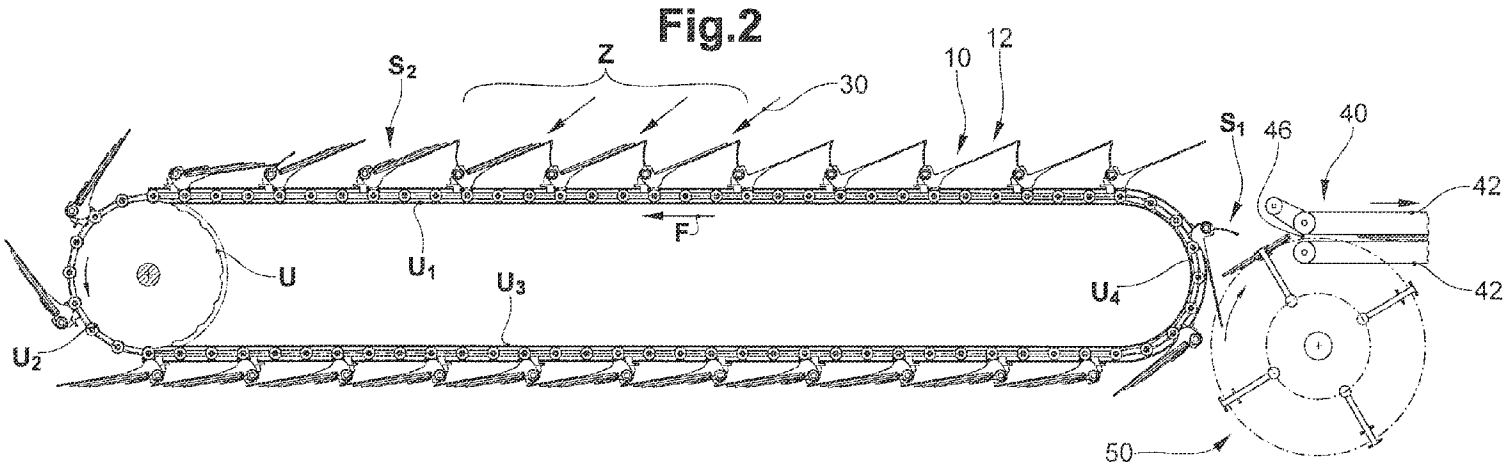
FIG. 2 a variant of the collation device according to FIG. 1.

In the example of FIGS. 1 and 2, the first gripper jaws 14 closer to the conveying member 2 are extended compared to the second gripper jaws 16. Their length corresponds roughly to the maximal length of the fed products 100, measured in the conveying direction F. The grippers 12 are orientated relative to the conveying path U such that the extended gripper jaws 14 in the collation region Z run essentially horizontally, or inclined at an angle of approx. 30-40° in the conveying direction F. In the collation region Z, the shorter gripper jaws 16 project essentially vertically upwards. The extended gripper jaws 14 therefore define an essentially horizontal or, for the purpose of aligning the products 100, slightly inclined rest surface 22 for the products 100 fed by the feed devices 30. The shorter gripper jaws 16 are orientated such that they do not block the product feed in the collation region Z, but they may function as an abutment for the leading product edges. The abutment, as is shown here, may also be realised by another shape of the first gripper jaw 14 (abutment edge 18).

The distance of two consecutive grippers 12, the length of the two gripper jaws 14, 16 and their orientations here are selected such that in the collation region Z, the gripper jaws 14, 16 of adjacent grippers are adjacent to one another in an essentially gapless manner and define a quasi continuous zigzag-like area. By way of this, one prevents the products from inadvertently getting into the gaps between the grippers 12 and disturbing the operation. Preferably, the distance of the grippers may be adapted to the size of the products. The long gripper jaw may for example be flexible, in order to be able to compensate distance changes, e.g. by way of sagging. Alternatively, the long gripper jaw or an element attached thereto (e.g. the second gripper part 14*b* shown in FIG. 8) may be exchangeable.

The transfer device 50 in the form of a transfer wheel grips the product stacks 110 by way of transfer elements 52, e.g. grippers, clamping elements, at the side edges and transfers these to the conveying-away device 40. This comprises two conveyor belts 42 which are driven in opposite directions and which enclose a gap-like conveying channel 46. The stacks 110 approach the transfer device 50 from the top and are taken over by this tangentially to the initial conveying path U and are moved further, tangentially to the movement path of the transfer elements 52.

The collation device 1 according to FIG. 2, with regard to its essential elements, corresponds to that of FIG. 1. The two upper and lower path pieces U1, U3 are likewise designed parallel to one another and here in a straight manner. The conveying direction F is anti-clockwise in contrast to FIG. 1. The path pieces U1, U2, U3, and U4 are run through in this sequence, i.e. the curved path piece U2 is at the left in the drawing and the further curved path piece U4, in whose region the transfer device 50 is also located, is at the right in the drawing. Accordingly, the grippers 12 have an arrangement which is mirrored to FIG. 1. The collation region Z here, as with FIG. 1, is located in the upper path piece U1. The products 100 are grouped into stacks 110 and as stacks 110 are moved almost along the complete conveying path U up to the transfer device 50. This arrangement has the advantage that a greater stretch is available for the collation region Z and that defect stacks in the lower region U3 are conveyed upside-down and may thus be ejected by way of opening individual grippers 12.

The collation devices 1 which are shown in FIGS. 1 and 2 moreover permit a "repair" function, i.e. a repair of product stacks which have been collated in a faulty manner. Hereby, individual stacks, by way of selective non-opening of the grippers 12, are not transferred to the transfer device 50 and thus run anew through the collation stretch Z. Faulty products may then be added. Such a repair run-through is triggered by a control device, after a monitoring device has detected a defect stack. Alternatively or additionally, an ejection device may be present, which ejects the defect stack, e.g. by way of the gripper being opened, when a defect is ascertained. The ejection device is provided which in the conveying direction (F) is arranged in front of a transfer region of the conveying path and which is capable of selectively bringing the grippers into the open position, in order to remove defect stacks of objects out of the grippers. A monitoring device which, with a defect on feeding the objects or with a stack formation, sends a control signal to the ejection device, which initiates this into ejecting the defect stack, or initiates a repair run-through.

Figure 3:
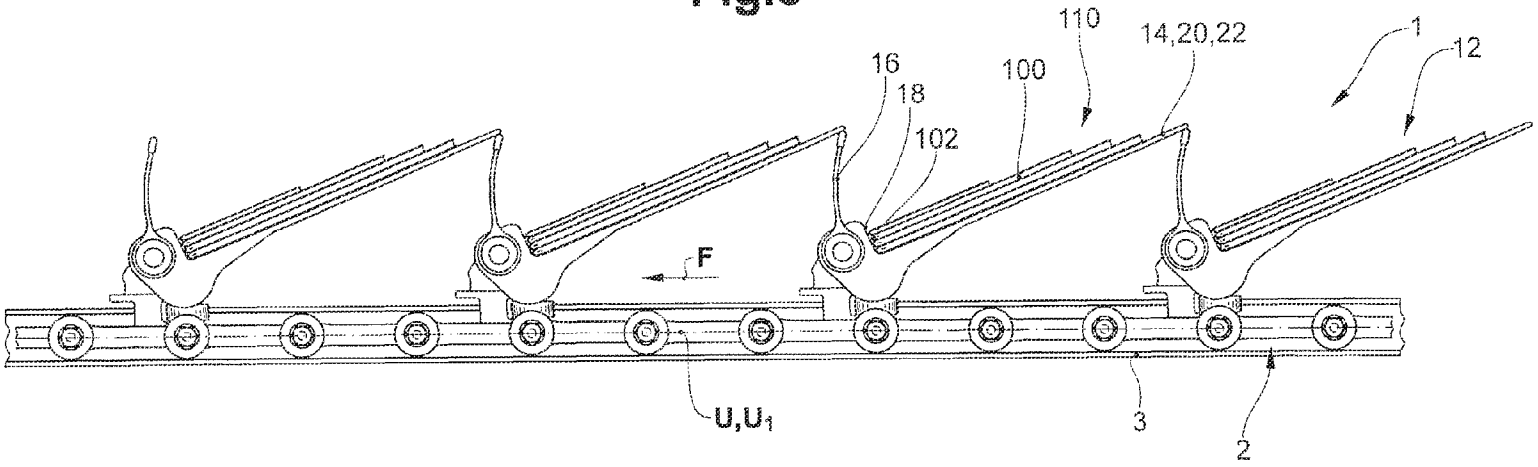
FIGS. 3 and 4 details of the collation device according to FIG. 2.
Figure 4:
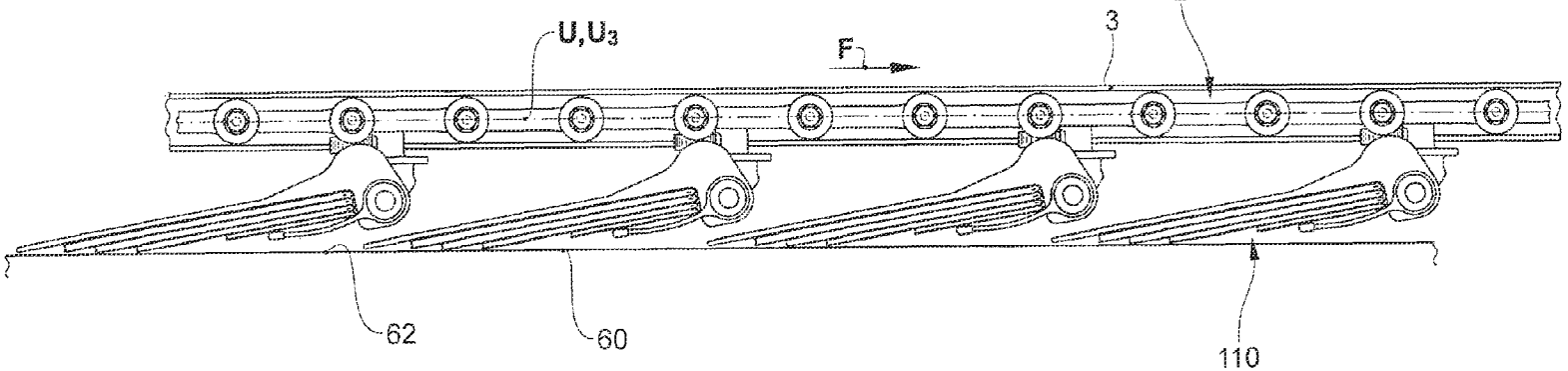

FIGS. 3 and 4 show details of the revolving path U of the device 11 of FIG. 2 in the region U1 (FIG. 3) or U3 (FIG. 4). In the case of FIG. 3, the grippers 12 are opened, and the products 100 lie on the rest surface 22 which is formed by the extended gripper jaw 14. This gripper jaw 14 is inclined in the conveying direction F relative to the revolving path U1. With this, the products 100 with their leading edges 102 are aligned on an abutment 18 which is formed by the extended gripper jaw 14. As already described, the outer edges of the gripper jaws 14, 16 of neighbouring grippers 12 are adjacent to one another, so that a quasi-continuous surface is formed in the collation region Z.

In FIG. 4, the grippers are closed and orientated such that the product stacks 110 are conveyed in a position, in which the products 100 are orientated largely parallel to the revolving path U. The products 100 are additionally supported from below by a support device 60 with, for example, a low-friction support surface 62 or co-running support belts.

Figure 5:
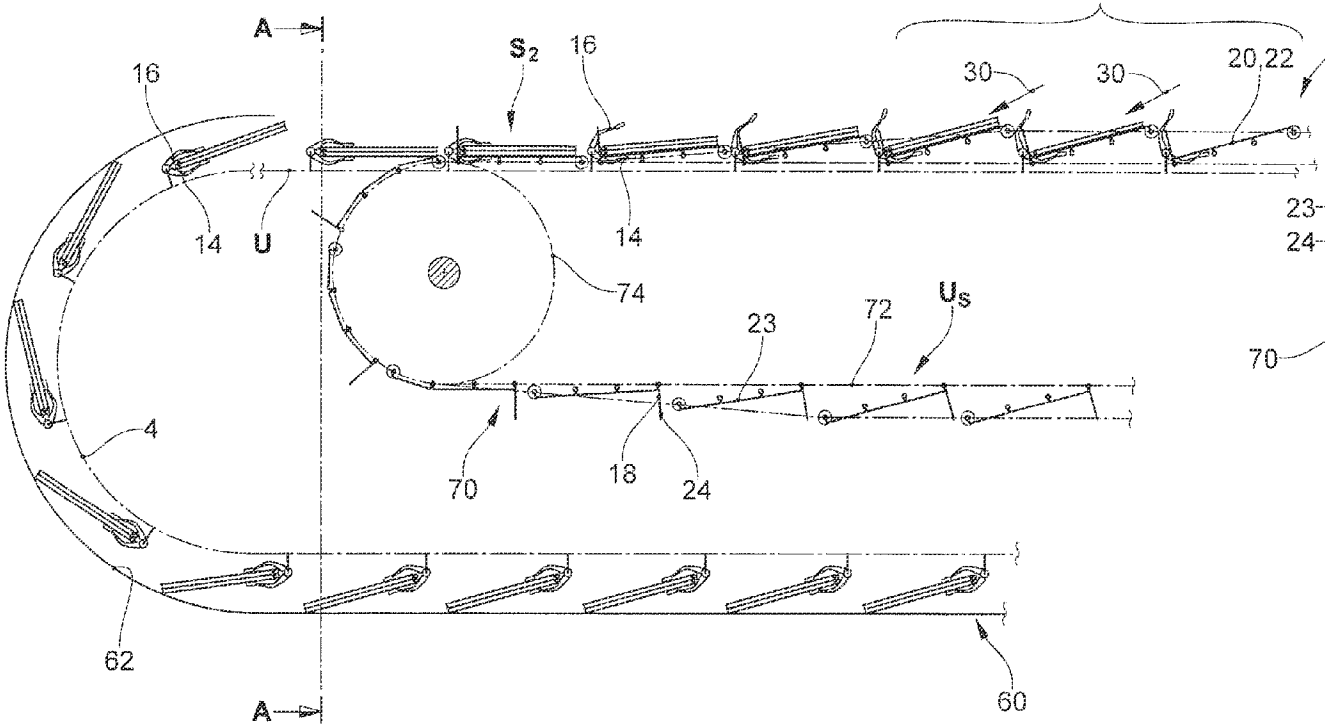
FIG. 5 a collation device with support elements which are separate from the grippers, FIG. 6 a view of the collation device according to FIG. 5 along the line A-A.

FIG. 5 shows a further embodiment of the invention, with which the rest surfaces 22 are formed by separate support elements 20 which are independent of the grippers 12. The grippers 12 are part of a, for example, conventional gripper conveyor and here have two essentially equally long gripper jaws 14, 16. The opening condition of the grippers 12 and their orientation relative to their conveying path U is set by way of control cams which are not represented here. A part of the conveying path U acts as a collation region Z. The grippers before this are opened at an opening location S1 and thereafter are closed at a closure location S2.

The support elements 20 are part of a support element conveyor 70 which is independent of the gripper conveyor. This support element conveyor comprises a support element conveyor member 72, with which the support elements 20 are moved along a closed support element conveying path $U_s$. The support element conveying path $U_s$, at least in the collation region Z, runs parallel to the conveying path U of the grippers 12 and is deflected by way of deflections 74, of which only one is represented here. The support elements 20 have the shape of compartments which are L-shaped in a lateral view, wherein the long limb 23 of the L consists of several segments which are connected to one another in a movable manner. By way of this, the support elements 20 may be led around the deflections 74 in a space-saving manner. The upper side of the long limb 23 acts as a support surface 22, and the region, in which the two limbs 23, 24 of the L-shaped support elements 20 meet one another, which is to say the shorter limb 24, acts as an abutment 18 for aligning the products 100.

The support elements 20 are moved synchronously to the grippers 12 in the collation region Z. Thereby, the abutment 18 is arranged flush with the gripper jaw. Moreover, the long limb 23 is inclined in the conveying direction. The products 100 are, therefore, aligned to the gripper jaw by way of the abutment 18 and may be gripped by way of closure of the grippers 12. After the closure location S2, the product stacks 110 may be held by the grippers 12 alone, and the conveying path $U_s$ of the support elements may take a different path than that of the grippers 12. Here, the free ends of the products 100, as with FIG. 2, are supported by a support device 60 with a support surface 62 which runs parallel to the conveying path U and which here is arranged in the region of the left defection 4.

This variant has the advantage that one may use a conventional gripper conveyor. This may also be part of an extensive conveyor installation. An additional circulation with the support elements 20 is only envisaged in the collation region. The collating and conveying function may therefore be realised with existing installations without much more additional effort with regard to design.

Figure 6:
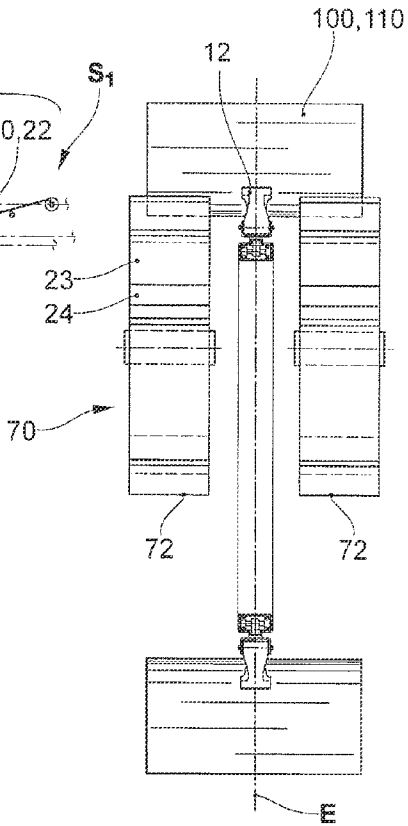

FIG. 6 shows a plan view of the collation device of FIG. 5 along the line A-A. One recognises that the support element conveyor 70 comprises two parallel conveyor members 72 for support elements 20 which in each case are arranged laterally of the path plane E of the grippers 12. In each case two support elements 20 support the products 100 in the open grippers 12 therefore in the region of their side edges.

Figure 7A:
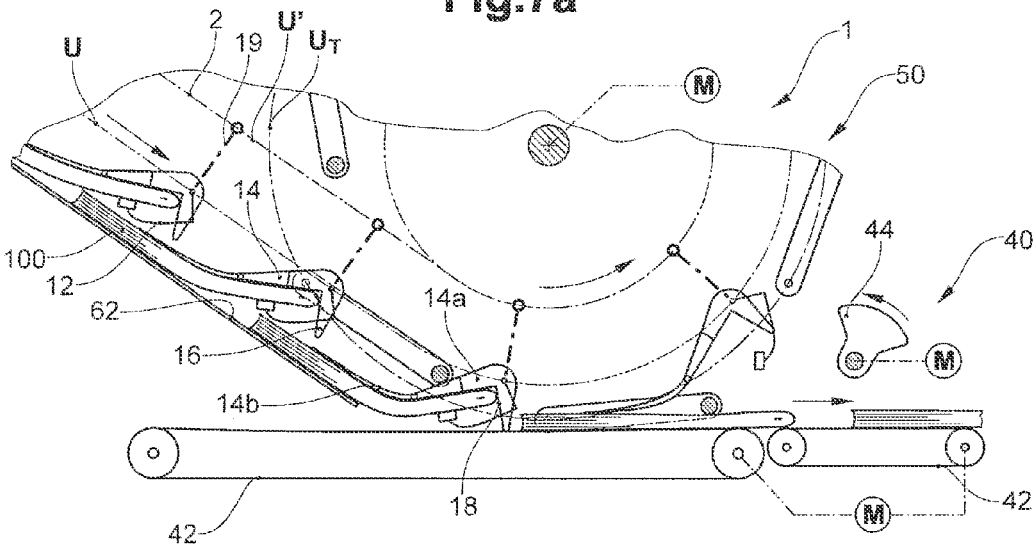
FIGS. 7*a-c* part views of a collation device with support elements, which are an integral constituent of the grippers, in different momentary glimpses, with the product transfer to a conveying-away device.
Figure 7B:
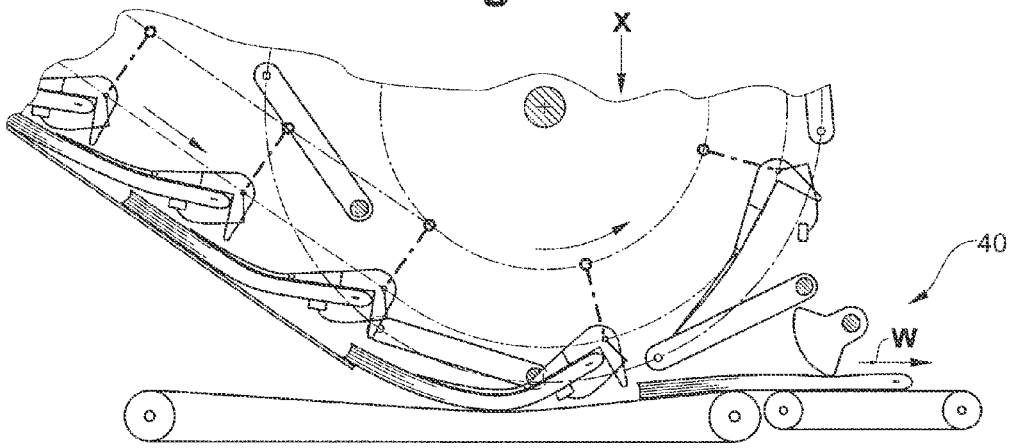
Figure 7C:
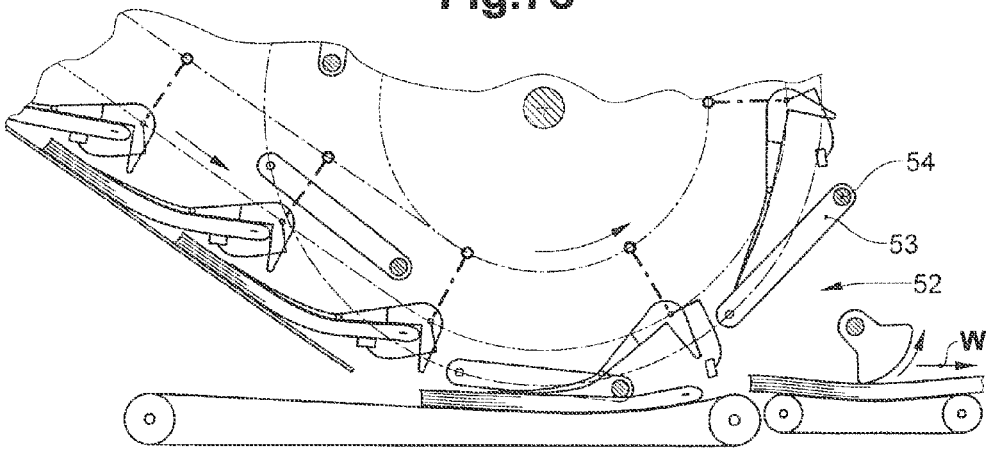
Figure 8:
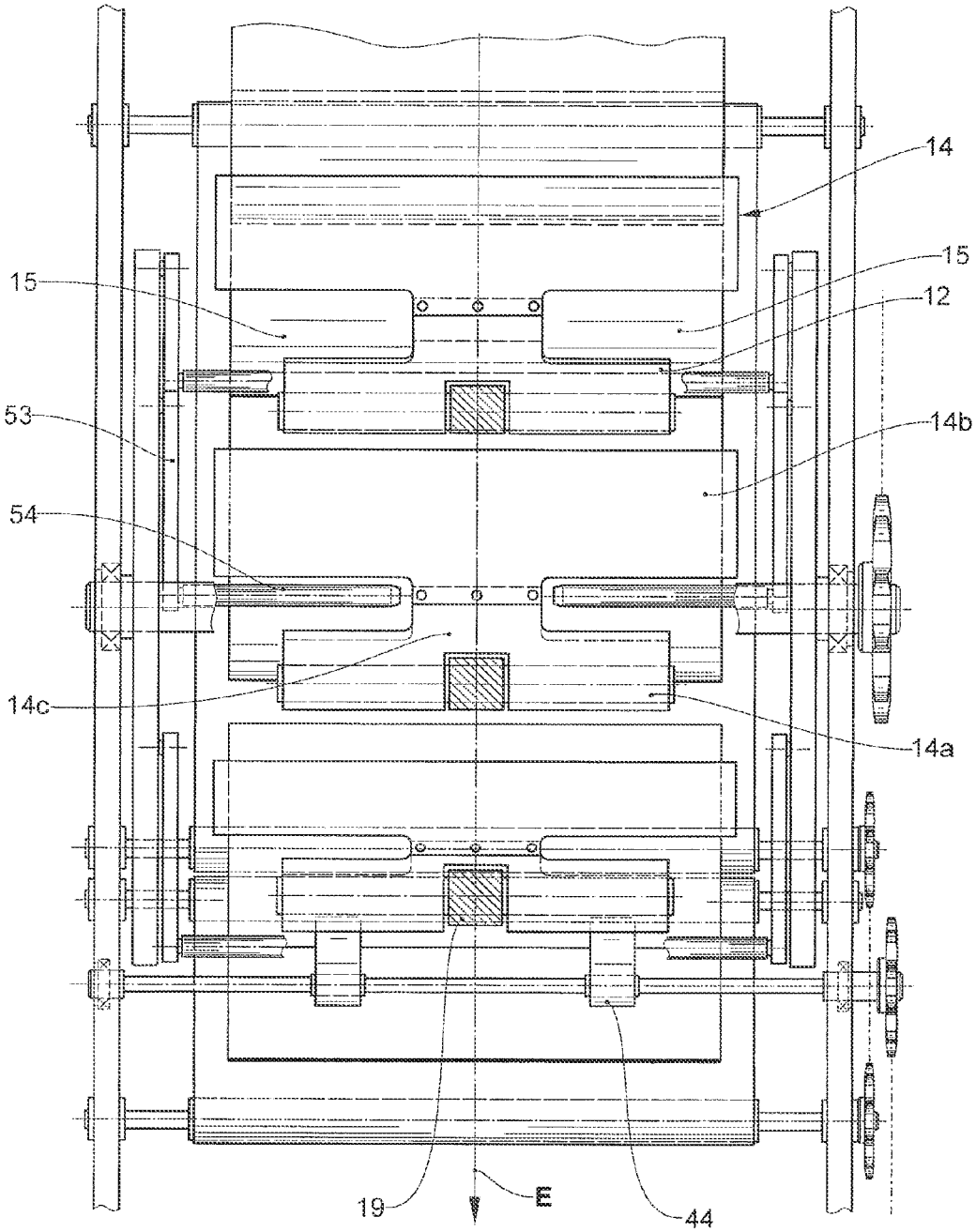
FIG. 8 a plan view of the device of FIG. 7*b* on the conveying surface of the conveying-away device FIGS. 9 and 10 views of collation devices with a non-linear plan view.

FIGS. 7*a-c* show a part view of a collation device 1 in the region of the product transfer to a conveying-away device 40, at different points in time. FIG. 8 shows a view of the device in the direction which is marked at x in FIG. 7*b*.

The collation device 1 in principle is constructed as in one of the FIGS. 1-4, i.e. it comprises a gripper 12 with differently long gripper jaws 14, 16. The longer gripper jaw 14 serves as a rest surface 22 for the products 100 or product stack 110. The shorter gripper jaw 16 serves for firmly clamping the products 100 against the other gripper jaw 14. Here, schematically only a single product 100 is represented, but it may also be the case of stacks 110.

As FIG. 8 shows, the long gripper jaw 14 consists of two parts 14*a*, 14*b*. A first part 14*a* which as a rule is rigid, is connected to the other gripper jaw 16 in an articulated manner. The abutment 18 is also formed on it. A second part 14*b* is arranged on the end of the first part 14*a* which is away from the joint. The connection may be rigid or flexible. In the present case, the connection is rigid, but the second gripper part 14*b* is two-dimensional and is designed intrinsically flexible or supple. The two gripper parts 14*a*, 14*b* are only connected to one another via a narrow material bridge 14*c*, so that two lateral recesses 15 are formed between the two gripper parts 14*a*, 14*b*, and the function of these recesses is explained further below. The angle between the two gripper parts 14*a*, 14*b* or the bending may also be varied in a controlled manner when required.

The grippers 12 in the present case run along a revolving path U. They are connected at equal distances via levers 19 to the conveyor member 2 running along a parallel revolving path U'. The levers 19 have the function of being able to change the distances of the grippers 12 in curved parts of the revolving path U. Here, the product release region is envisaged in the curved part of the revolving path U. Successive products 100 which have been conveyed still in a partly overlapping manner in the straight part, are therefore pulled apart without much effort by way of the path curvature.

A support surface 62 which is orientated parallel to the revolving path U, is provided in the straight path part. Thanks to its flexibility, the second gripper part 14*b* adapts to the orientation of the support surface 62, so that the products 100 are guided or supported by both sides before the transfer.

The revolving path U runs onto the conveyor plane of the conveying-away device 40 at an angle. The conveying-away device 40 as with FIG. 1 or 2 comprises one or more conveyor belts 42, onto which the products 100 or stacks 110 are deposited and then released by way of opening the grippers 12. The deposited products 100 are subsequently accelerated by an acceleration element 44, e.g. by a cam driven by a motor, in the conveying-away direction W, as well as press against the rest, here a further conveyor belt, and transported away.

With the described collation devices 1, increasingly one creates more complex formations, for example product stacks 110 with several individual products 100, which e.g. may comprise also thicker printed products, goods samples, CDs or other non-printed products. With such stacks 110, it is essential that the individual products 100 do not mutually dislocate on transfer to the conveying-away device 40. This is because such displacement may upset the procedure in stations arranged downstream, e.g. on film-wrapping. The transfer devices 50 which are represented in FIGS. 1 and 2 engage a product stack 110 from both sides. The transfer however takes place at one point, specifically where the paths of the grippers 12 and the transfer elements 52 meet one another tangentially.

FIGS. 7*a-c* and 8 show a variant of a transfer device 50, which is integrated into the deflection 4 of the conveyor member 2 which functions as a transfer region, for the grippers 12, and permits a very reliable transfer also of more complex product stacks 110. It comprises a plurality of transfer elements 52 which are moved along a circular path $U_T$ running parallel to the conveying path U. The transfer elements 52 comprise levers 53 which are pivotable on a drive means, e.g. a wheel, and which at their free end comprise a transverse rod 54 orientated perpendicularly to the revolving path $U_T$. As FIG. 8 shows, the transfer device 50 here comprises two drive means which are arranged in a mirror-symmetrical manner to the plane E and transfer elements 52 which are attached thereon. The transverse rods 54, in each case, of two transfer elements 52 lying opposite one another are moved through the recesses 15 between the two gripper parts 14*a*, 14*b* before and with the product transfer. They press the product 100 or the product stack 110 against the conveyor rest of the conveying-away device 40 before, during and after the opening of the grippers. After gripping the products 100 by way of the acceleration element 44, the lever 53 is pivoted upwards. This transfer device 50 has the advantage that the position of the products 100 or of the stacks 110 at every point in time is held and secured against displacement either by way of the grippers 12 in combination with the support surface 62, and/or by way of the transverse rods 54 in combination with the conveyor rest and/or by way of the conveying-away device 40 per se. The transfer elements 52 accompany the products 100 over a certain stretch and hold these together, with the transfer. Thus one achieves a reliable transfer of the products 100.

The transfer elements 52 may, for example, also be deactivated in a controlled manner. This is important, for example, with a repair run-through, when the products are not to be released from the grippers 12.

The described procedures and functions are monitored and controlled by a control unit which is not represented here in more detail. The control unit, apart from suitable sensorics/electronics, may also comprise stationary and/or changeable control cams and/or activation elements which cooperate with suitable control elements on the moved components (grippers, support elements, transfer elements). Moreover, for example suitable drives are present, which are controlled by the control unit.

Figure 9:
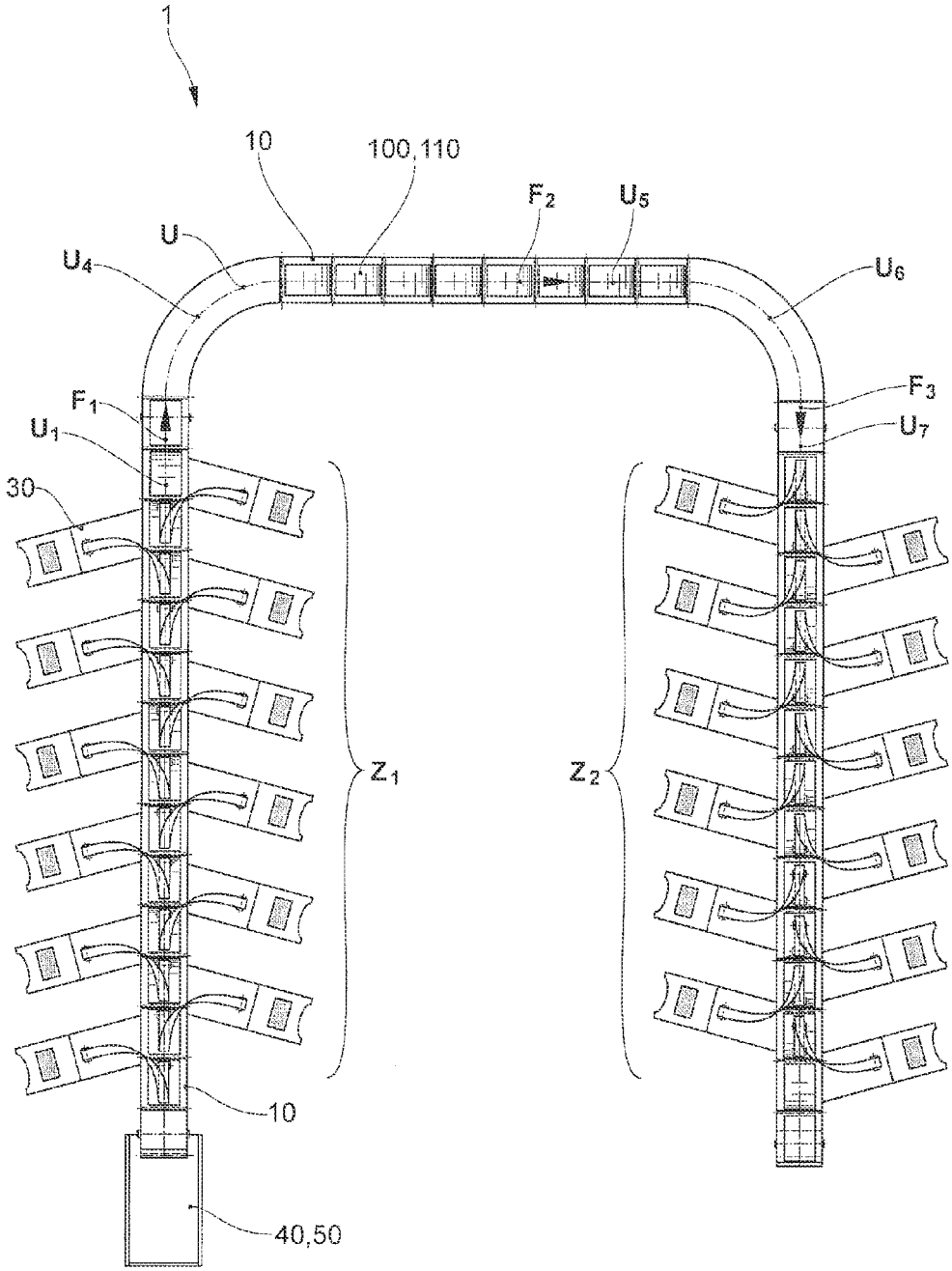
Figure 10:
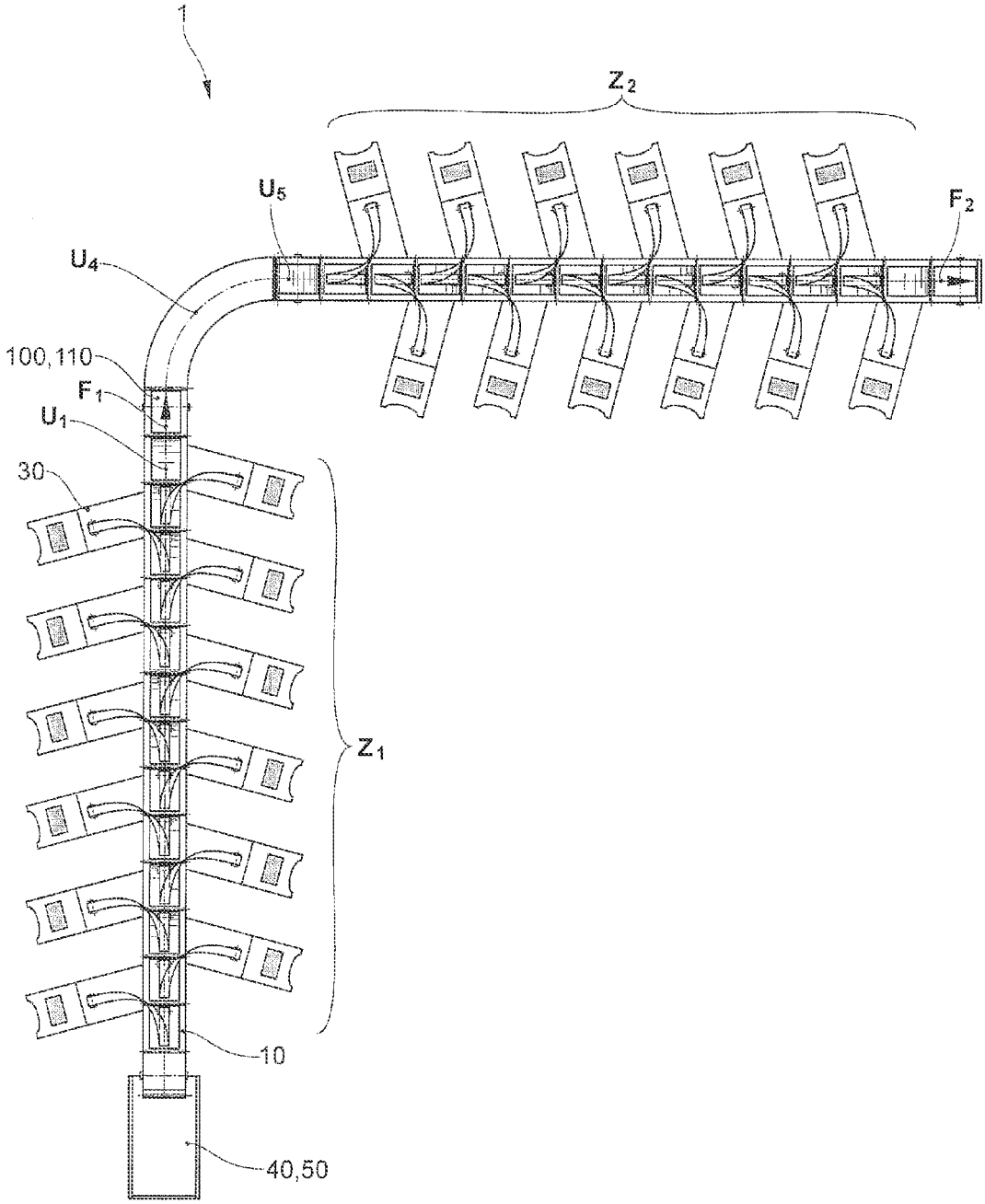

FIGS. 9 and 10 show two examples for collation devices 1 with a ground plan which is not linear in a plan view. The conveying path U in the case of FIG. 9 has a U-shaped plan view, and with FIG. 10 the plan view is L-shaped. In a lateral view, the movement path may be designed as in FIG. 1 or 2, i.e. the receiver compartments 10 are moved in the arrow direction (conveying direction F1, F2, F3) in the upper part of the conveying path U and opposite to the arrow direction in the lower part. Both arrangements permit a large quantity of feed stations 30 to be accommodated in a limited space.

In the example of FIG. 9, the conveying path U has a U-shaped plan view with a first linear region U1 with a conveying direction F1, with a second linear region U5 with a conveying direction F2 and with a third linear region U7 with a conveying direction F3. The conveying directions F1 and F3 are opposite to one another and the conveying direction F2 runs perpendicularly to this. The linear regions are connected to one another by way of arcuate sections U4 and U6. In the first and third linear region U1 and U7 respectively, the first and second collation regions Z1, Z2 are realised in each case with a plurality of feed devices 30. The conveying-away device 40, as the case may be with an additional transfer device 50, is located at the outermost end of the left limb. It is achieved after a complete passage of the regions U1, U4-U7 and the respective rear sections of the conveying path which are not visible here.

The grippers are opened before entry into the first collation region Z1. They are preferably closed before the first curved section U4, so that the collated objects 100 or object stacks 110 do not dislocate by way of centrifugal forces. They are opened again, at the latest, before entry into the second collation region Z2 and are closed at its end before running through the rear conveying path region.

The installation of FIG. 10 has two linear conveying path sections U1, U5 which are connected to one another by way of an arcuate section U4. The conveying directions F1, F2 in the linear regions U1, U5, are offset by 90° to one another. In the first and second linear region U1 and U5 respectively, the first and second collation regions Z1, Z2 are in each case realised with a plurality of feed devices 30.

The invention claimed is:

1. A device for collating two-dimensional, flat objects, in particular printed products, and for the further conveying of the collated objects as stacks, with the device comprising:

a plurality of receiver units which are movable in a conveying direction (F) along a closed conveying path (U) defined by a conveyor member wherein the receiver units comprise grippers with a first and second gripper jaw, wherein the grippers may assume a clamping position and an open position;

a plurality of support elements which at least in a collation region (Z) of the conveying path (U), define a rest surface which is inclined in the conveying direction and onto which the objects may be deposited wherein the support elements are designed as a constituent of the grippers, by way of the first gripper jaw being extended with respect to the second gripper jaw and at least in the open position forming a rest surface for the objects, wherein the grippers are capable of firmly holding the objects lying on the rest surface, between their gripper jaws, by way of transition from the open position into the clamping position; and the first gripper law comprises a rigid first gripper part which cooperates with the second gripper jaw for firmly holding the objects, as well as a second gripper part which is inherently flexible, or flexibly connected or connected in an articulated manner to the first gripper part, and which is capable of supporting the objects in their region which is away from the connection region between the two gripper jaws;

the grippers and their support elements are connected to the conveyor member and controllable in a manner such that within a receiver unit, the orientation of the rest surface relative to the conveying path (U) and/or an opening angle between the first and second gripper jaw may be set independently of adjacent receiver units.

2. A device according to claim 1, wherein an angle between the rest surface and the conveying path may be set by way of the gripper as a whole or the first gripper jaw being pivotable relative to the conveying path (U).

3. A device according to claim 1, wherein the support elements are formed independently of the grippers as separate support elements and are moved with a support element conveying member along a closed support element conveying path (US) which at least in the collation region (Z) runs parallel to the conveying path (U) of the grippers.

4. A device according to claim 3, wherein the support elements are formed by way of rigid or partly flexible bodies or by way of belts which may be deflected about deflection means.

5. A device according to claim 1, wherein the grippers at least in the collation region (Z) form an abutment for the objects lying on the rest surface by way of the connection region between the two gripper jaws.

6. A device according to claim 5, wherein the rest surfaces at least in the collation region (Z) are inclined relative to the conveying direction (F) in a manner such that the objects are aligned on the abutment on account of gravity.

7. A device according to claim 1, wherein an angle between the support elements and the conveying path (U) may be set, in a manner such that the orientation of the rest surfaces is kept constant at least in the collation region (Z).

8. A device according to claim 1, wherein a control device which controls the grippers, by way of at least one control cam and/or at least one activation element, in a manner such that they are opened at an opening location (S1) lying in front of the collation region (Z) in the conveying direction (F) and are closed at a closure location (S2) lying after the collation region (Z) in the conveying direction (F).

9. A device according to claim 1, wherein a plurality of feed devices for individual objects to be collated, whose exits in the collation region (Z) lie one after the other in a row which is essentially parallel to the conveying path (U), wherein aligning elements for laterally aligning the objects before or during the release to the receiving units are present.

10. A device according to claim 1, wherein at least one transfer device with a plurality of transfer elements which in a transfer region of the conveying path (U) is capable of cooperating with the receiver units in a manner such that stacks which are held by the receiver units are moved out of the receiver units after opening the grippers.

11. A device according to claim 1, wherein at least one conveying-away device which in particular comprises at least one belt conveyor which is capable of taking over stacks of objects, from a transfer region of the conveying path (U) or from a transfer device.

12. A device according to claim 1, wherein the conveying path (U) has a plan view with direction changes, and is designed in a U-shaped or L-shaped manner in a plan view.

13. A device according to claim 12, wherein the conveying path (U) comprises at least two collation regions (Z), through which the objects run with a different conveying direction.

14. A method for collating two-dimensional, flat objects, in particular printed products, and for the further conveying of the collated objects as stacks, comprising the following steps:

providing a device according to claim 1, moving the receiver units in the conveying direction (F) along the closed conveying path (U);

feeding objects one after the other to the receiver units in the collation region (Z) of the conveying path (U);

laying the objects onto the rest surfaces of the receiver units, for forming stacks, closing the grippers after formation of the stacks and further conveying the stacks by way of the grippers.

15. A method according to claim 14, wherein the support elements in the collation region (Z) are moved synchronously to the grippers.

16. A method according to claim 14, wherein the opening condition of the grippers and the orientation of the rest surface within a receiver unit is set independently of the opening condition of the grippers and of the orientation of the rest surface within an adjacent receiver unit.

17. A method according to claim 14, wherein the stacks of objects during the transfer to a conveying-away device are secured at every point in time against displacement within the stack, by way of transfer elements which are co-moved with the stack.

* * * * *